US006074265A

United States Patent [19]

Barthold

[11] Patent Number: 6,074,265

[45] Date of Patent: Jun. 13, 2000

[54] GLIDER TOY HAVING INTEGRAL LAUNCHER

[75] Inventor: Mark J. Barthold, Redondo Beach, Calif.

[73] Assignee: Mattel, Inc., El Segundo

[21] Appl. No.: 09/227,677

[22] Filed: Jan. 8, 1999

[51] Int. Cl.[7] ..... A63H 27/22

[52] U.S. Cl. ..... 446/61

[58] Field of Search ..... 446/52, 53, 54, 446/63, 64, 65

[56] References Cited

U.S. PATENT DOCUMENTS

| | | |
|---|---|---|
| 1,144,914 | 6/1915 | Pierson . |
| 1,400,224 | 12/1921 | McInnis . |
| 1,408,001 | 2/1922 | Hauck . |
| 3,187,460 | 6/1965 | Robertson . |
| 3,909,976 | 10/1975 | Kirk . |
| 4,060,930 | 12/1977 | Hirtle et al. . |
| 4,863,412 | 9/1989 | Mihalinec . |
| 5,061,217 | 10/1991 | Miller et al. . |
| 5,240,448 | 8/1993 | Ishikawa . |
| 5,846,112 | 12/1998 | Baker ..... 446/68 |

*Primary Examiner*—Robert A. Hafer
*Assistant Examiner*—Jeffrey D. Carlson
*Attorney, Agent, or Firm*—Roy A. Ekstrand

[57] ABSTRACT

A glider body preferably formed of a light weight material such as foam plastic defines a sufficiently aerodynamic shape to glide through the air. A launcher assembly is secured to the under side to the glider body and includes a stretched elastic member supported upon a launcher frame defining a channel therethrough. The elastic member is retained so as to span the frontal portion of the channel. A launcher handle includes an upper portion having a notch and a forwardly extending tine configured to be received within the channel and to engage the spanning portion of elastic member. The launcher handle and glider are drawn apart to store energy in the elastic member which upon release of the glider launches the glider into flight carrying the launcher assembly therewith.

11 Claims, 2 Drawing Sheets

GLIDER TOY HAVING INTEGRAL LAUNCHER

FIELD OF THE INVENTION

This invention relates generally to toy gliders and particularly to those having launchers comprising elastic members.

BACKGROUND OF THE INVENTION

Early development of gliders and glider models actually presided the development of powered aircraft by many years. Such gliders were fabricated and studied as practitioners in the art endeavored to understand the principles of flight and aerodynamics. The first heavier than air flying devices were gliders in one form or another. Initially perhaps, gliders were fabricated and shaped to resemble birds or other flying animals. Over time however, practitioners studying flight realized a basic principle of aerodynamic lift which allowed greater freedom in designing glider craft which did not necessarily resemble a bird. The basic structure which evolved comprised any elongated fuselage supporting pairs of outwardly extending wings and a vertical tail surface. Portions of the wing and tail surfaces are pivotally secured to the supporting structure to impart control forces for adjusting the trim and flight path of the glider.

As the development of gliders became more understood and sophisticated, toy gliders began to appear having shapes and fabrications which generally mimic the larger glider craft. Such toy often have preset control surfaces for trimming flight. Despite the tendency of practitioners in the toy and craft arts to fabricate gliders which resemble glider aircraft, a variety of "fanciful" shapes such as monsters, animals, or the like have also been provided.

While no doubt initial glider toys were launched by being thrown or dropped from some high position, various types of launchers have been developed. Perhaps the most pervasive type of glider toy launcher is found in glider toy launchers which employ an elongated rubberband or spring. The principle for operation for such launchers is relatively simple and comprises drawing the glider toy rearwardly against the spring or rubberband to store energy therein. When the glider is released the engagement of the spring or rubberband propels the glider toy forwardly with sufficient speed to launch its flight. Not surprisingly, a variety of launching devices for use with glider toys have been provided by practitioners in the toy arts.

An early example of such rubberband launched glider toys is found in U.S. Pat. No. 1,400,224 issued to McInnis which sets forth a TOY AEROPLANE OR GLIDER having a glider formed of a fuselage opposed wings and a tail rutter apparatus. A handle device supports a U-shaped rubberband while the glider supports an elongated centerline rod. The centerline rod is placed within the end portion of the rubberband and the combination thereof is drawn away from the handle to stretch the rubberband. When the rubberband is released the combination of the glider and the elongated rod is propelled forwardly.

U.S. Pat. No. 4,863,412 issued to Mihalinec which sets forth a GLIDER TOY ASSEMBLY having a glider comprising a fuselage and opposed wings as well as a rear tail and elevator structure. The undersurface of the glider includes a notch which receives a portion of a rubberband or the like. The notch is shaped to engage the rubberband in the rearward direction and release it in the forward direction. The rubberband is supported by a fork-like handle similar to a sling-shot. In addition, the wings of the glider are pivoted during the launch process and extend forwardly during.

U.S. Pat. No. 1,408,001 issued to Hauck sets forth AERIAL TOY having a folded glider defining a frontal portion supporting a rubberband or the like. The launch is carried forward by grasping one end of the rubberband and drawing the glider rearward and thereafter releasing it.

U.S. Pat. No. 4,060,930 issued to Hirtle et al sets forth TOY AIRPLANE LAUNCHER having a launch platform for supporting two toy airplanes each of which include a rubberband engaging portion an a depending projection. The platform includes apparatus for restraining the airplane in a cocked position after the airplane is drawn against the resilient force of the rubberband. A trigger mechanism releases the airplane and launches it in a manner resembling the catapult of a aircraft carrier.

U.S. Pat. No. 3,187,460 issued to Robertson sets forth a GLIDER WITH FLEXING WING in which a portion of the glider wing is flexible or pivotally moveable to alter the flight path of the glider.

In addition to gliders resembling aircrafts such as those set forth above, various other differently shaped gliding toys have been provided. For example, U.S. Pat. No. 5,240,448 issued to Ishikawa sets forth a GLIDER PLANE SET having a launcher base configured in the shape of a miniature aircraft helmet and defining a thumb receiving recess therein. An elongated rubberband or the like is secured to the base and engages the underside of the glider for launching purposes.

U.S. Pat. No. 5,061,217 issued to Miller et al sets forth a TOY FOAM PLASTIC GLIDER WITH DETACHABLE PYLON WINGS which functions as a conventional glider with the wings attached and which facilitates removal of the wings to facilitate flightless play with the toy animal.

U.S. Pat. No. 3,909,976 issued to Kirk sets forth a GLIDER TOY having an elongated light-weight flexible resilient body supporting a frontal weight therein. The glider is launched by simply throwing it.

U.S. Pat. No. 4,512,690 issued to Johnson sets forth a FLYING FIGURE TOY GLIDER having a body portion of low density construction such as foam and having the appearance of a superhero with an outwardly extending cape wing structure. Transparent portions extend the wing structure to provide sufficient wing surface for flight.

While the forgoing described prior art devices have generally improved the art and in some instances enjoyed commercial success, there remains nonetheless a continuing need in the art for evermore easily operated, effective and amusing glider toy sets.

SUMMARY OF THE INVENTION

Accordingly, it is a general object of the present invention to provide an improved glider toy set. It is a more particular object of the present invention to provide an improved glider toy set which functions in an efficient reliable manner and which is easy to launch by young children. It is a still more particular object of the present invention to provide an improved glider toy set in which the launcher mechanism is for the most part integrally formed with the glider.

In accordance with the present invention there is provided a glider toy comprising: a glider constructed to glide through the air when launched; a launcher assembly secured to the glider, the launcher assembly having an elongated launcher frame defining a hook and a band support at opposed ends, and an elastic member formed into a closed loop and stretched between the band support and the hook; and a launcher handle having a handle body defining an upper end having a notch formed therein, the band support defining a pair of arms and a space therebetween and the elastic member spanning the space whereby the upper end is insertable into the space to position the elastic member within the notch and whereby the elastic member is stretched by separating the launcher handle and the glider to store energy in the elastic member and thereafter the glider is released for launch carrying the launcher assembly in flight.

BRIEF DESCRIPTION OF THE DRAWING

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
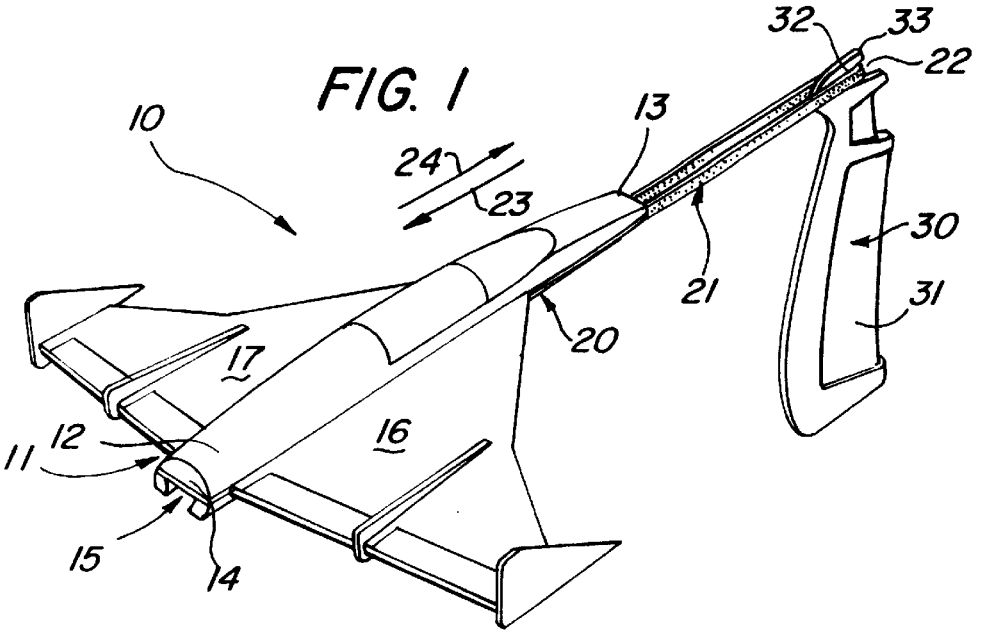
FIG. 1 sets forth a perspective view of the present invention glider toy in the to be launched configuration.

FIG. 1 sets forth a perspective view of a glider toy fabricated in accordance with the present invention and generally referenced by numeral 10. Glider toy 10 includes a glider 11 together with a launcher handle 30 and a launcher assembly 20 which corporate to facilitate the launch of glider 11 in the manner set forth below in greater detail. By way of overview, launcher 20 is secured to glider 11 and supports an elongated closed loop elastic member 21 having an end 22 which is received upon the upper portion of launcher handle 30 and which is stretched to store launcher energy therein. When glider 11 is released the stored energy in elastic member 21 drives glider 11 forwardly past launcher handle 30 and into a flight path. Of importance with respect to the present invention and is described below in greater detail launcher assembly 20 including elastic member 21 remains secured to glider 11 during flight.

More specifically, glider 11 includes an elongated fuselage 12 supporting delta wings 16 and 17. Fuselage 12 further defines an underside channel 15 extending from a tail 14 to a frontal nose 13. Thus channel 15 extends generally front to back along fuselage 12 on the underside thereof. In the manner described below in greater detail an elastic member 21 having a looped end 22 is coupled to glider 11 at the remaining end thereof.

A launcher handle 30 includes a handle-body 31 defining an upper tine 33 and a notch 32. Notch 32 receives end 22 of elastic member 21 in preparation for launch. Handle body 31 may be variously formed without departing from the spirit and scope of the present invention. In addition launcher handle 30 may if desired be fixed to a supporting object rather than hand-held without departing from the spirit and scope of the present invention.

In the preferred fabrication of the present invention glider 11 is formed of a molded light-weight foam material to reduce the overall weight of glider 11 and facilitate extended flight. It will be apparent to those skilled in the art however, that other materials such as molded plastic or light-weight woods ect. may be utilized without departing from the spirit and scope from the present invention. Further it will be apparent to those skilled in the art that while the preferred fabrication of elastic member 21 is found in a conventional rubberband, other elastic members may be utilized without departing from the spirit and scope of the present invention so long as they provide the frontal U-shaped portion having a closed-end similar to end 22 and thereby allow energy stored therein. For example, elastic member 21 may be formed of a coil spring or other elastic material without departing from the spirit and scope of the present invention. Further it will be apparent to those skilled in the art that while a delta wing fighter air craft is depicted in the embodiments set forth below, a virtually endless variety of gliders of the like may be used in connection with the present invention glider toy without departing from the spirit and scope of the present invention.

In operation the user grips glider 11 (usually at tail 14) and passes tine 33 above end 22 such that end 22 of elastic member 21 is received within notch 32. With temporary reference to FIG. 2 a section view of the upper portion of handle body 31 is shown in which end 22 of elastic member 21 is received within notch 32 of handle body 31 such that tine 33 extends forwardly and above end 22. The position shown in FIG. 2 represents this initial position in preparation for a glider launch.

Returning to FIG. 1, the position shown results from the user having held launcher 30 with one hand grasping handle body 31 and grasping glider 11 and drawing the glider rearwardly in the direction indicated by arrow 23 while handle launcher 30 is fixed. Alternatively, the user may simply hold the position of glider 11 and gripping handle 31 extend forwardly with the same result. The essential element of glider and launcher handle movement is the stretching of elastic member 21. Once the desired stretch has been applied to elastic member 21 and thereby storing the desired energy therein. At this point launch is achieved by simply releasing glider 11 and allowing the stored energy within elastic member 21 to accelerate glider 11 forwardly in the direction indicated by arrow 24. In accordance with important aspect of the present invention set forth below in greater detail notch 32, tine 33, and launcher assembly 20 corporate to allow glider 11 to pass freely across the upper portion of handle launcher 30 and thereafter continue in flight.

Figure 2:
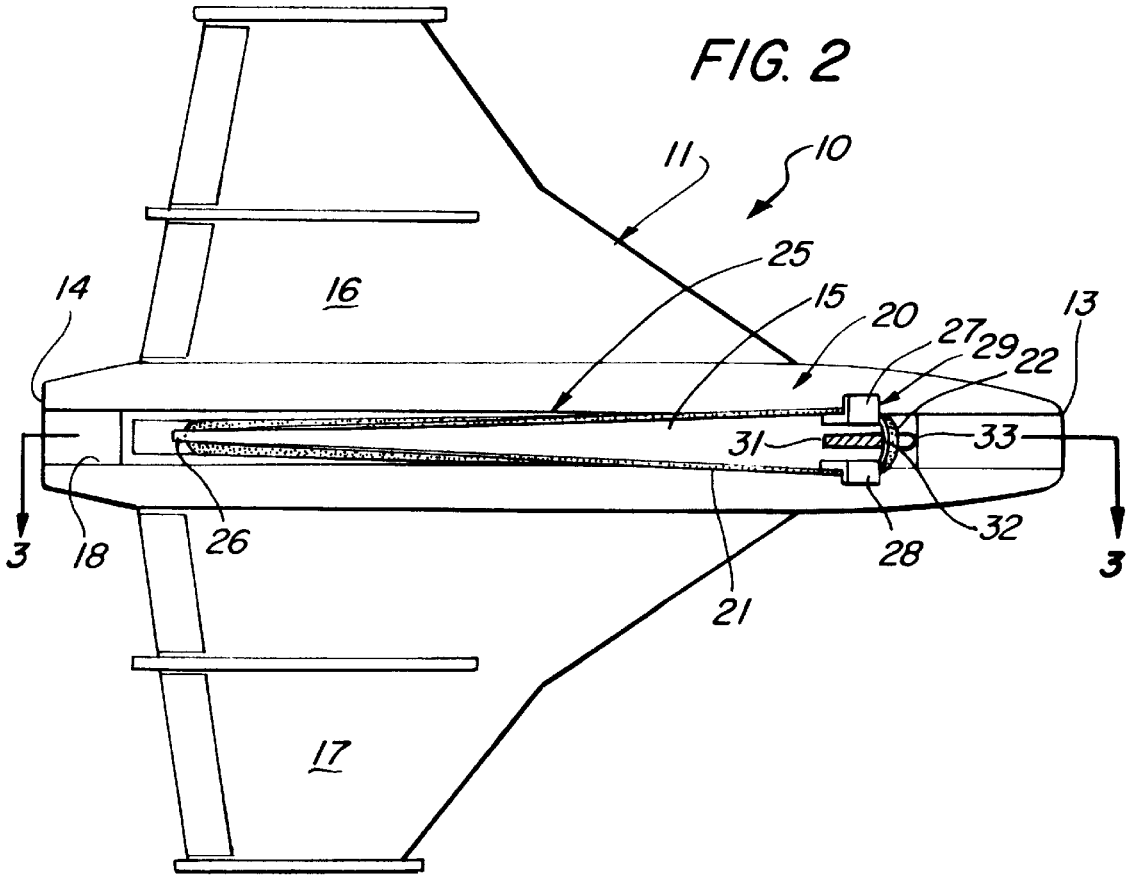
FIG. 2 sets forth a bottom view of the present invention glider toy.

FIG. 2 sets forth a bottom view of glider toy 10 having glider 11 supporting launcher assembly 20. As described above glider 11 includes a fuselage 12 defining a channel 18 extending the length of fuselage 12 on the underside thereof. A launcher assembly 20 is received within channel 18 and secured therein by conventional fastening means such as adhesive attachment or alternatively a gripping structure such as that set forth below in FIG. 6. In either event the important aspect of the attachment of launcher assembly 20 within channel 18 is a firm secure attachment sufficient to resist the force imparted to glider 11 during launch operations.

Launcher assembly 20 further includes a band support 29 having generally U-shaped spaced apart arms 27 and 28 on each side of a channel 15 formed within launcher frame 25. Launcher frame 25 further includes a rearwardly extending hook 26. A closed loop elastic member 21 is received upon hook 26 and stretch forwardly to encircle arms 27 and 28. Of importance with respect to the present invention is the positioning of elastic member 21 to a slightly stretched position between hook 26 and arms 27 and 28 such that an end portion 22 of elastic member 21 spans the gap between arms 27 and 28. For purposes of illustration a section view of the upper portion of handle body 31 is shown positioned in the initial operation of preparing glider 11 for launch. As positioned, end portion 22 of elastic member 21 is received within a notch 32 formed beneath tine 33 of handle body 31.

As mentioned above, glider 11 is preferably formed of a light-weight material such as foam plastic or the like and depicts an exemplary air craft having wings 16 and 17, a nose 13, and a tail 14.

Figure 3:
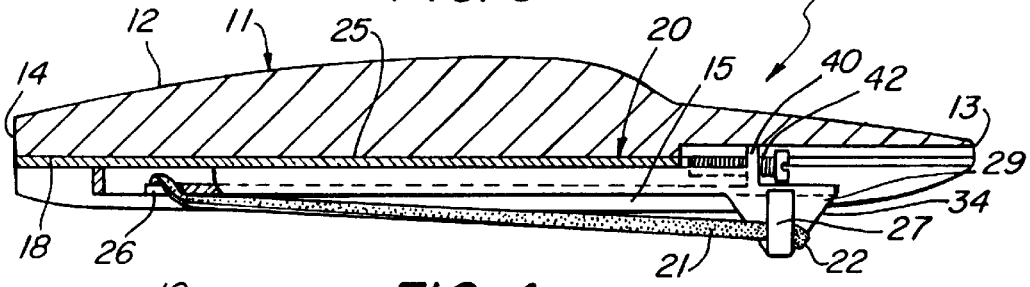
FIG. 3 sets forth a section view of the present invention glider toy taken along section lines 3—3 in FIG. 2.

FIG. 3 sets forth a section view of glider toy 10 taken along section lines 3—3 in FIG. 2. As described above glider toy 10 includes a glider 11 having a fuselage 12 forming a nose 13 and a tail 14. Also formed in fuselage 12 is a front to back channel 18.

Figure 5:
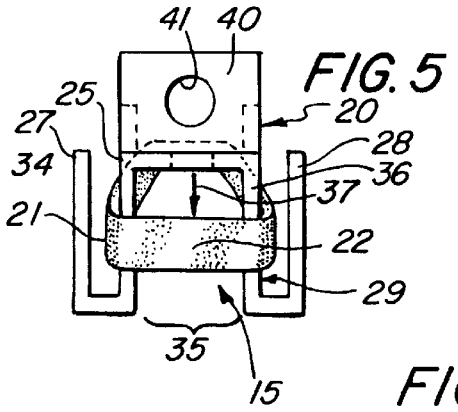
FIG. 5 sets forth a front perspective view of the launching mechanism of the present invention glider toy.
Figure 6:
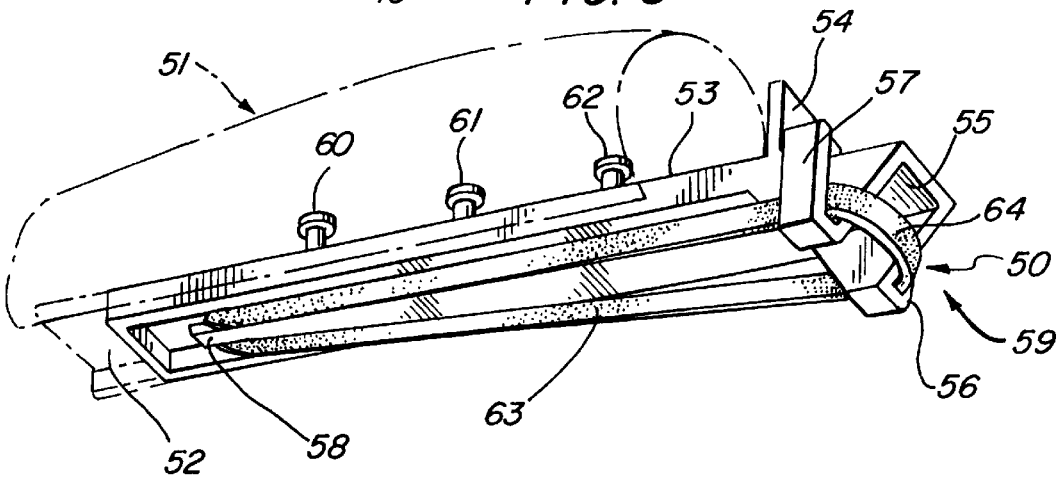
FIG. 6 sets forth a perspective view of an alternate embodiment of the present invention glider toy.

A launcher assembly 20 includes a launcher frame 25 received within channel 18 of fuselage 12 in a secure attachment which may be provided by adhesive attachment, fasteners, or the molded in fabrication shown in FIG. 6. Launcher assembly 20 includes a hook 26 extending rearwardly within channel 15 together with a band support 29 extending downwardly form the frontal portion of launcher frame 25. Band support 29 includes a pair of U-shaped arms 27 and 28 (arm 28 shown in FIG. 5) together with a upwardly extending flange 40. As is also better seen in FIG. 5, flange 40 defines a threaded aperture 41. Returning to FIG. 3, a threaded bolt 42 is threadably received within flange 40 and is adjustable in its position with respect to fuselage 12. The position of bolt 42 is adjusted to obtain the desired center of gravity for glider 11 and thereby optimize its flight characteristics.

Band support 29 further defines an angled surface 34 upon which end 22 of elastic member 21 is received. The function of angle surface 34 assures the return of end 22 of elastic member 21 to the bottom portions of arms 27 and 28 (arm 28 seen in FIG. 5) following glider launch. The tension within elastic member 21 draws end 22 downwardly with respect to surface 34 as the glider takes flight. In addition, arms 27 and 28 corporate to maintain the stretched end of elastic member 21 within band support 29 following launch as elastic member 21 returns to its normal position.

Figure 4:
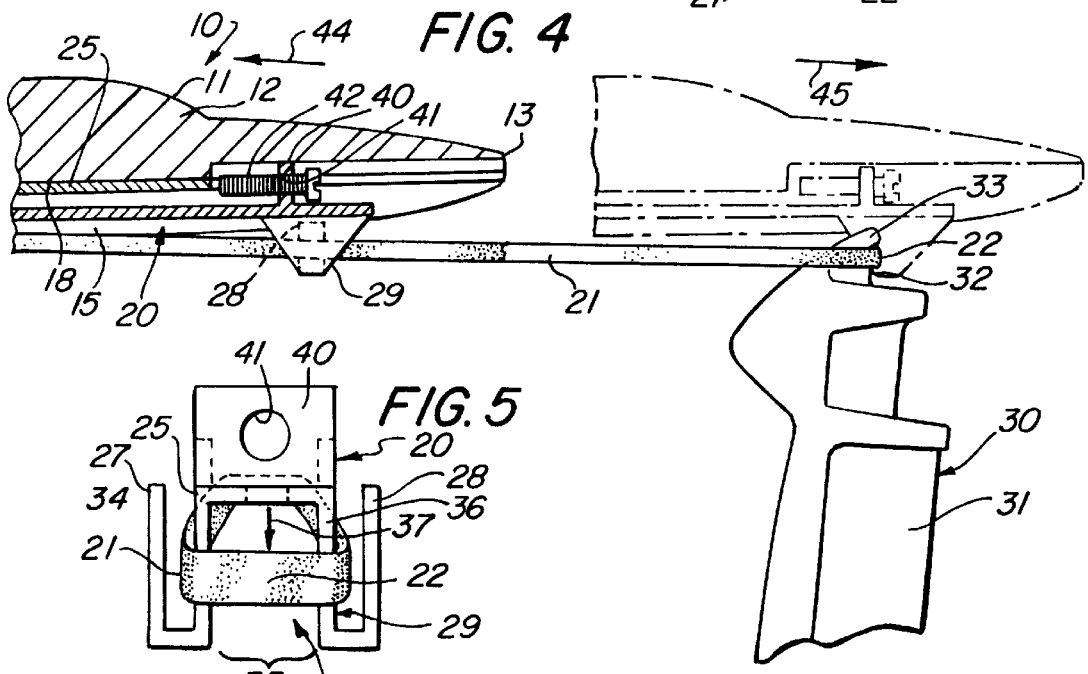
FIG. 4 sets forth a partial view of the present invention glider toy preparing for launch.

FIG. 4 sets forth a partial section view of the initial stretching of elastic member 21 in preparation for a launch. In FIG. 4 a dash line representation of glider 11 is shown while a subsequent position of glider 11 as elastic member 21 is drawn is shown in solid line representation. As described above, glider toy 10 includes a glider 11 having a fuselage 12 defining a channel 18 therethrough. Fuselage 12 further defines a nose portion 13. In further accordance with the present invention, a launcher assembly 20 is secured within channel 18 of fuselage 12 and includes a band support 29 extending downwardly from the frontal portion thereof. As seen in FIG. 5, band support 29 defines a pair of arms 27 and 28. Also formed in frame 25 is a flange 40 which defines a threaded aperture 41. A bolt 42 is received within aperture 41 and is adjusted to control the center of gravity of glider 11. Elastic member 21 is secured at hook 26 (seen in FIG. 3) and extends forwardly to end 22. The ladder is received within notch 32 formed beneath tine 33 of handle body 31. In the position shown, launcher handle 30 is moving forwardly in the direction indicated by arrow 45 relative to glider 11. As mentioned above, energy may be stored within elastic member 21 by either movement of launcher handle 30 forwardly while grasping glider 11 or alternatively by holding launcher handle 30 firmly and drawing glider 11 rearwardly in the direction indicated by arrow 44. In either event, energy is thereby stored within elastic member 21 as it stretches. To obtain launch the user maintains the position of launcher handle 30 and releases glider 11. As the energy in elastic member 21 is transferred to glider 11, glider 11 is accelerated forwardly in the direction indicated by arrow 45.

FIG. 5 sets forth a front view of launcher assembly 20 showing frame 25. As described above, frame 25 supports a pair of spaced apart U-shaped arms 27 and 28 and an upwardly extending flange 40. Flange 40 defines a threaded aperture 41 which receives bolt 42 (seen in FIG. 4) for center of gravity adjustment of glider 11. Frame 25 further defines a channel 15 terminating in a space 35 between the interior surfaces of arms 27 and 28. Elastic member 21 is received upon the interior of the U-shaped structure formed by arms 27 and 28 and frame 25 such that and end portion 22 thereof spans space 35. Thus end portion 22 of elastic member 21 forms a spanning portion of the elastic member. As is better seen in FIG. 3, the remaining end of closed loop elastic member 21 is secured to a hook 26 at the rear of frame 25. The frontal portion of frame 25 together with arms 27 and 28 form band support 29. In turn, band support 29 defines a pair of inclined surfaces 34 and 36 which are inclined downwardly and rearwardly and upon which end 22 of elastic member 21 are received. As described above, the inclined facets provided by surfaces 34 and 36 urge end 22 of elastic member 21 downwardly in the direction indicated by arrow 37 toward the bottom portion of arms 27 and 28. This is of particular importance with respect to the present invention during the launching process as previously stretched elastic member 21 is contracting and returning to the position shown in FIG. 3 while accelerating glider 11. The angle of surfaces 34 and 36 repositions elastic member 21 and particularly end 22 thereof at a sufficiently low point upon surfaces 34 and 36 to facilitate the next launching engagement by handle launcher 30 in the manner seen in FIG. 4.

FIG. 6 sets forth a perspective view of an alternate embodiment of the present invention showing a portion of fuselage 51 together with a launcher assembly 50. By way of overview, launcher assembly 50 is substantially identical to launcher assembly 20 described above with the acceptation of an alternative attachment mechanism being provided for securing the launcher assembly to a glider fuselage. In the embodiments described above utilizing launcher assembly 20, an adhesive attachment is formed between the launcher frame and the glider fuselage. In the embodiment of fuselage FIG. 6, a plurality of headed posts 60, 61 and 62 extend upwardly from launcher assembly 50. These headed posts may be molded into a foam molded glider during the molding process to eliminate the need for adhesive attachment.

More specifically, launcher assembly 50 includes a launcher frame 53 having a channel 55 formed therein. A hook 58 is supported at one end of channel 55 while a band support 59 is supported at the opposite end. Posts 60, 61 and 62 extend upwardly from the upper surface from launcher frame 53. A pair of arms 56 and 57 substantially identical to arm 27 and 28 of launcher assembly 20 (seen in FIG. 5) are formed upon band support 59. A closed loop elastic member 63 is received upon hook 58 and stretched forwardly to be received upon band support 59 forming a spanning end 64. Fuselage 51 is representative of a molded fuselage and functions to receive posts 60, 61, and 62 during the molding process in which launcher frame 53 is thereby secured to fuselage 51. As described above, the structure and operation apart from the use of headed posts of 60, 61 and 62 of launcher assembly 50 is substantially identical to launcher assembly 20 shown and described above in FIGS. 1–5.

What has been shown is a glider toy having an integral launcher in which the operational simplicity for young children is greatly enhanced by providing a launcher assembly which is integrally formed with the glider and which is carried into flight therewith. The result is the child user need only manipulate a simple launcher handle and is able to engage and launch the glider toy in a very simple easy to perform manner. The elastic member is maintained within the launcher assembly of the glider such that it not be handled by the child user. The result is an effective low cost easy to use glider toy. In addition, the elastic member may be provided by a conventional rubberband which is replaceable by simply loosening the rubberband from the restraining hook and withdrawing it from the band support of the launcher assembly. A new rubberband is simply and easily replaced in a reverse operation. Thus as elastic members brake, the child user is readily able to replace them or alternatively to select elastic members of different thickness and strength to accommodate varying strengths and development of the child user.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A glider toy comprising:

a glider constructed to glide through the air when launched;

a launcher assembly secured to said glider, said launcher assembly having an elongated launcher frame defining a hook and a band support at opposed ends, and an elastic member formed into a closed loop and stretched between said band support and said hook; and a launcher handle having a handle body defining an upper end having a notch formed therein, said band support defining a pair of arms and a space therebetween and said elastic member spanning said space whereby said upper end is insertable into said space to position said elastic member within said notch and whereby said elastic member is stretched by separating said launcher handle and said glider to store energy in said elastic member and thereafter said glider is released for launch carrying said launcher assembly in flight.

2. The glider toy set forth in claim 1 wherein said launcher frame defines a downwardly open channel extending from said space toward said hook.

3. The glider toy set forth in claim 2 wherein said band support and said pair of arms form a pair of generally U-shaped members on each side of said space.

4. The glider toy set forth in claim 3 wherein said band support defines a pair of facets angled rearwardly and downwardly which urge said elastic member toward the bottoms of said generally U-shaped members following a glider launch.

5. The glider toy set forth in claim 4 wherein said launcher frame further defines a flange and a weight movably supported thereon for adjusting the center of gravity of said glider.

6. The glider toy set forth in claim 5 wherein said flange defines a threaded aperture and wherein said weight defines a cooperating thread such that said position of said weight is adjusted by rotating said weight.

7. The glider toy set forth in claim 1 wherein said elastic member is a rubberband.

8. The glider toy set forth in claim 1 wherein said launcher frame is secured to said glider by an adhesive.

9. The glider toy set forth in claim 1 wherein said launcher frame includes a plurality of upwardly extending posts and wherein said glider includes a glider body formed upon said posts to secure said launcher frame to said glider.

10. The glider toy set forth in claim 2 wherein said launcher handle upper end includes a tine above said notch, said upper end being small enough to freely move within said channel.

11. A glider toy comprising:

a glider having an undersurface and a body adapted to glide through the air in flight when launched;

a launcher assembly having an elongated frame secured to said undersurface and defining an elongated channel and a hook at one end thereof and a band support at the remaining end thereof, said launcher assembly further including an elastic member stretched between said hook and said band support, said band support defining a space communicating with said channel and a spanning portion of said elastic member spanning said space; and a launcher handle having a handle body defining an upper portion having a notch therein, said launcher handle being positioned to insert said upper portion into said channel such that said spanning portion is received in said notch and said glider and said launcher handle being drawn apart to stretch said elastic member and thereafter said glider being released to be launched into flight by said elastic member and carrying said launcher assembly into flight.

* * * * *